US011650528B2

(12) United States Patent
Ohashi et al.

(10) Patent No.: US 11,650,528 B2
(45) Date of Patent: May 16, 2023

(54) RESISTANCE HEATING COMPONENT, METHOD OF MANUFACTURING THE SAME, FIXING DEVICE, AND IMAGE FORMING APPARATUS

(71) Applicant: FUJIFILM Business Innovation Corp., Tokyo (JP)

(72) Inventors: Takashi Ohashi, Kanagawa (JP); Takashi Matsubara, Kanagawa (JP); Takuma Ishihara, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/411,468

(22) Filed: Aug. 25, 2021

(65) Prior Publication Data

US 2022/0373944 A1 Nov. 24, 2022

(30) Foreign Application Priority Data

May 21, 2021 (JP) ..... JP2021-085902

(51) Int. Cl.
*G03G 15/20* (2006.01)
*H05B 3/46* (2006.01)

(52) U.S. Cl.
CPC ..... *G03G 15/2053* (2013.01); *G03G 15/2064* (2013.01); *H05B 3/46* (2013.01); *G03G 2215/2032* (2013.01); *H05B 2203/017* (2013.01)

(58) Field of Classification Search
CPC ..... G03G 15/2017; G03G 15/2053; G03G 15/2057; G03G 2215/2003; H05B 3/46
See application file for complete search history.

(56) References Cited

U.S. PATENT DOCUMENTS

2011/0091251 A1* 4/2011 Kim ..... G03G 15/2053 219/534
2011/0236089 A1* 9/2011 Tanaka ..... G03G 15/2053 399/329

FOREIGN PATENT DOCUMENTS

JP 2-134667 A 5/1990

* cited by examiner

*Primary Examiner* — Thomas S Giampaolo, II
(74) *Attorney, Agent, or Firm* — Sughrue Mion, PLLC

(57) ABSTRACT

A resistance heating component is to come into contact with and heat a fixing belt made of a heat resistant material, and is to be provided at a position away from a fixing area between which the resistance heating component and the fixing belt a recording material is held and conveyed, the resistance heating component including: a metal base material having a low heat capacity; and a resistance heating layer laminated on a front surface or a rear surface of the base material with an insulating layer interposed between the base material and the resistance heating layer.

18 Claims, 8 Drawing Sheets

RESISTANCE HEATING COMPONENT, METHOD OF MANUFACTURING THE SAME, FIXING DEVICE, AND IMAGE FORMING APPARATUS

CROSS-REFERENCE TO RELATED APPLICATIONS

This application is based on and claims priority under 35 USC 119 from Japanese Patent Application No. 2021-085902 filed on May 21, 2021.

BACKGROUND

(i) Technical Field

The present disclosure relates to a resistance heating component, a method of manufacturing the resistance heating component, a fixing device, and an image forming apparatus.

(ii) Related Art

For example, the fixing device described in Japanese Unexamined Patent Application Publication No. 2-134667 has been already known as a conventional fixing device.

Japanese Unexamined Patent Application Publication No. 2-134667 discloses a fixing device including: a heating element fixed and supported; a film that slides with the heating element; and a pressurizing device that pressure-bonds a recording material to the film, the heating element having a heat generating layer provided on a substrate, an electrode which carries current to the heat generating layer, and a thermally meltable part which is provided on the substrate, and melts at a predetermined temperature to prevent current carrying to the heat generating layer.

SUMMARY

Aspects of non-limiting embodiments of the present disclosure relate to a resistance heating component with a short start-up time without increasing a heat capacity, the resistance heating component allowing a fixing device to be easily built, the fixing device having a large fixing area and being capable of coping with high productivity.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a resistance heating component which is to come into contact with and heat a fixing belt made of a heat resistant material, and is to be provided at a position away from a fixing area between which and the fixing belt, a recording material is held and conveyed, the resistance heating component including: a metal base material having a low heat capacity; and a resistance heating layer laminated on a front surface or a rear surface of the base material with an insulating layer interposed between the base material and the resistance heating layer.

BRIEF DESCRIPTION OF THE DRAWINGS

Exemplary embodiments of the present disclosure will be described in detail based on the following figures, wherein.

DETAILED DESCRIPTION

Overview of Exemplary Embodiment

Figure 1A:
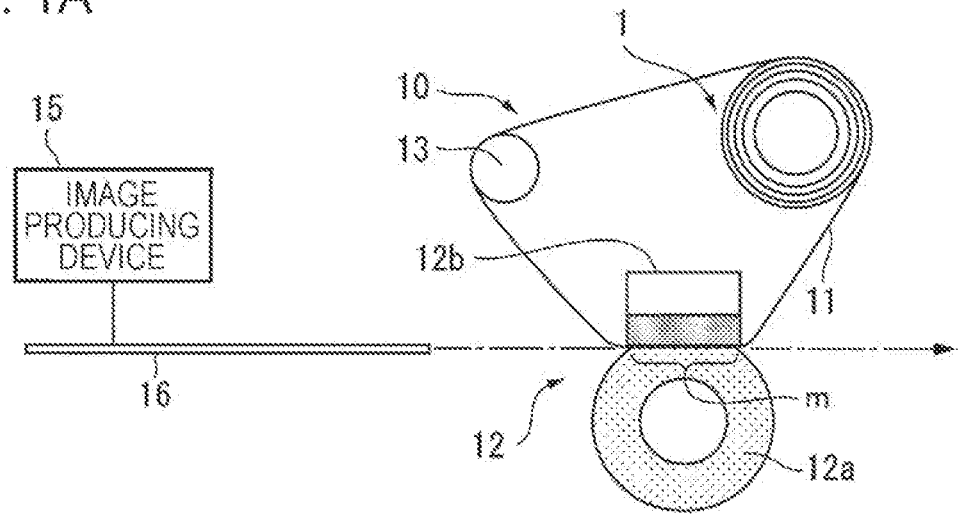
FIG. 1A is an explanatory view illustrating an overview of an exemplary embodiment of an image forming apparatus which uses a fixing device including a resistance heating component to which the present disclosure is applied.

FIG. 1A illustrates an overview of an exemplary embodiment of an image forming apparatus which uses a fixing device including a resistance heating component to which the present disclosure is applied.

In FIG. 1A, the image forming apparatus includes an image producing device 15 that produces an image on a recording material 16, and a fixing device 10 that fixes an unfixed image produced by the image producing device 15.

Here, any system, such as an ion flux recording system, including an electrophotographic system may be appropriately selected as the image producing device 15 as long as the system produces an unfixed image on the recording material 16.

In addition, the fixing device 10 includes a fixing belt 11 made of a heat resistant material that moves in circulation; a fixing area formation device 12 that fixes an unfixed image of a recording material 16 at a fixing area m between which and the fixing belt 11, the recording material 16 is held and conveyed; a resistance heating component 1 which comes into contact with and heats the fixing belt 11 at a position away from the fixing area m of the fixing belt 11; and a stretching member 13 that stretches the fixing belt 11 between the fixing area formation device 12 and the resistance heating component 1.

The fixing belt 11 extensively includes a belt made of a heat resistant material such as polyimide (PI), polyetherimide (PEI). In addition, the fixing area formation device 12 may be configured to hold and convey the recording material 16 in the fixing area m of the fixing belt 11, and is normally such that a receiving member 12*b* is provided on the rear surface side of the fixing belt 11, a pressurizing member 12*a* is arranged on the surface side of the fixing belt 11, and the fixing area m is ensured, in which the fixing belt 11 and the recording material 16 are held between the pressurizing member 12*a* and the receiving member 12*b*.

Particularly, in this example, the resistance heating component 1 that heats the fixing belt 11 is provided at a position away from the fixing area m of the fixing belt 11, thus the fixing area formation device 12 basically does not need to include a heating device. However, it is needless to say that a heating device may be provided supplementarily.

Thus, according to this example, as compared with when a heating area is provided in the fixing area of the fixing belt 11, the fixing belt 11, which has been sufficiently heated in the fixing area m, can be passed by separating the heating area and the fixing area m for the fixing belt 11 in function.

Figure 1B:
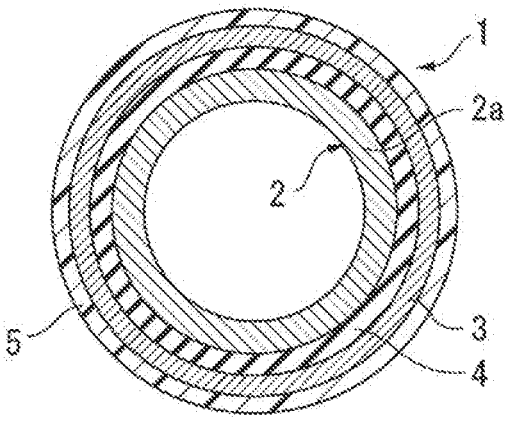
FIG. 1B is an explanatory view illustrating a configuration example of the resistance heating component illustrated in FIG. 1A.

In the exemplary embodiment, as illustrated in FIGS. 1A and 1B, the resistance heating component 1 is to be provided at a position away from the fixing area m of the fixing belt 11, and includes a base material 2 made of metal having a low heat capacity, and a resistance heating layer 3 laminated on the front or rear surface of the base material 2 with an insulating layer 4 interposed between the base material 2 and the resistance heating layer 3.

It is sufficient that the base material 2 be made of metal, and its form is not limited to a roll shape, but includes a flat plate shape. The resistance heating layer 3 may be on either the front or the rear surface of the base material 2. However, in consideration of reducing start-up time and energy saving of the resistance heating layer 3, a configuration in which the insulating layer 4 is interposed between the resistance heating layer 3 and the base material 2 is needed so that carried current to the resistance heating layer 3 does not leak to the base material 2 made of metal.

Next, a representative form or a desired form of the resistance heating component 1 according to the exemplary embodiment will be described.

First, as a desired form of the base material 2, a metal roll 2*a* comprised of a cylindrical body made of metal may be used.

In this example, it is desirable that the metal roll 2*a* be configurated of high tensile strength steel which has a tensile strength of 490 MP or higher. The thickness of the metal roll 2*a* may be selected based on the stiffness and workability.

When the metal roll 2*a* is used, the resistance heating layer 3 may be laminated on the surface of the metal roll 2*a* with the insulating layer 4 interposed therebetween.

In addition, when the resistance heating layer 3 is formed on the surface of the base material 2, regardless of the form of the base material 2, it is desirable to form a protective layer 5 on the resistance heating layer 3 of the base material 2 using a material having low mold releasability (for example, polyimide and PEEK material) in order to increase wettability of a lubricant and tack power for drive against the fixing belt 11.

Furthermore, the insulating layer 4 may be appropriately selected, however, in consideration of manufacturability, it is desirable to use the insulating layer 4 having an excellent surface property.

In particular, from the view point of maintaining the surface property of the resistance heating layer 3 in a good condition, it is desirable that the surface roughness of the insulating layer 4 be lower than the surface roughness of the base material 2.

In addition, the method of manufacturing the resistance heating component 1 may be appropriately selected, however, for example, when the metal roll 2*a* is configurated of high tensile strength steel, the following manufacturing method is desirable.

Figure 1C:
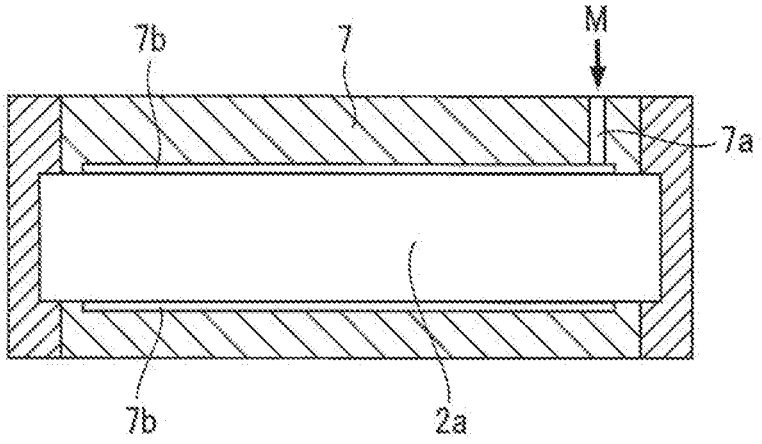
FIG. 1C is an explanatory view illustrating a method of manufacturing the resistance heating component.

Specifically, the method of manufacturing the resistance heating component 1 which comes into contact with and heats a fixing belt 11 made of a heat resistant material, and is provided at a position away from a fixing area m between which and the fixing belt 11, a recording material 16 is held and conveyed, the resistance heating component 1 including: a metal roll 2*a* formed of a cylindrical body as a metal base material 2 having a low heat capacity; and a resistance heating layer 3 laminated on an outer surface or an inner surface of the metal roll 2*a* with an insulating layer 4 interposed between the metal roll 2*a* and the resistance heating layer 1. The method includes layer formation steps in which laminated layers are successively formed on an outer circumference or an inner circumference of the metal roll 2*a*, the laminated layers including the insulating layer 4 and the resistance heating layer 3, and in at least an insulating layer formation step of the layer formation steps, a cast molding coating method is used in which as illustrated in FIG. 1C, the metal roll 2*a* is positioned, and a mold 7 for partitioning a hollow section 7*b* between the metal roll 2*a* and the outer circumference or the inner circumference of the metal roll 2*a* is used, the hollow section 7*b* corresponding to a thickness of a layer to be formed, and the layer to be formed is coated by casting a coating material M for the layer to be formed into the hollow section 7*b* through an inlet 7*a* which communicates with the hollow section 7*b*, and calcining the coating material M.

In this manufacturing method, the metal roll 2*a* is high tensile strength steel, and polyimide can be used as the coating material M for the insulating layer 4.

In addition, according to this manufacturing method, the cylindricity of the outer surface of the insulating layer 4 depends on the surface accuracy of the inner surface of the hollow section 7*b* of the mold 7, thus the cylindricity of the outer circumferential surface of the insulating layer 4 can be made closer to the cylindricity of a cylinder than the cylindricity of the metal roll 2*a*.

In addition, in the method of manufacturing the resistance heating component 1 of this type, when the resistance heating layer 3 is formed using the cast molding coating method also in a resistance heating layer formation step of the layer formulation steps, the surface of the resistance heating layer 3 can also be formed smoothly like the surface property of the insulating layer 4.

Next, a representative form or a desired form of the fixing device according to the exemplary embodiment will be described.

First, as a representative form of the resistance heating component 1, the resistance heating component 1 may be disposed in contact with the rear surface of the fixing belt 11.

In addition, from the view point of reducing the sliding resistance against the fixing belt 11, it is desirable that the resistance heating component 1 function as a stretching member which stretches the fixing belt 11. Furthermore, it is more desirable that the resistance heating component 1 function as a stretching member which stretches the fixing belt 11 and function as a driving member which drives the fixing belt 11.

In addition, in an embodiment in which the rear surface of the fixing belt 11 is heated by the resistance heating component 1, it takes time for the heat of the rear surface to conduct to the surface of the fixing belt 11, thus it is desirable that the relationship of L1>L2 be satisfied, where L1 (not illustrated in FIG. 1) is the distance from a contact center position of the resistance heating component 1 with the fixing belt 11 to a central position of the fixing area m in a circulation movement direction of the fixing belt 11, and L2 (not illustrated in FIG. 1) is the distance from the central position of the fixing area m to the contact center position in the circulation movement direction of the fixing belt 11.

In addition, an auxiliary heating element may be provided, which reduces heat loss when the fixing belt 11 heated by the resistance heating component 1 passes through the fixing area m.

Hereinafter, the present disclosure will be described in more detail based on the exemplary embodiment illustrated in the accompanying drawings.

Exemplary Embodiment 1

—Whole Configuration of Image Forming Apparatus—

Figure 2:
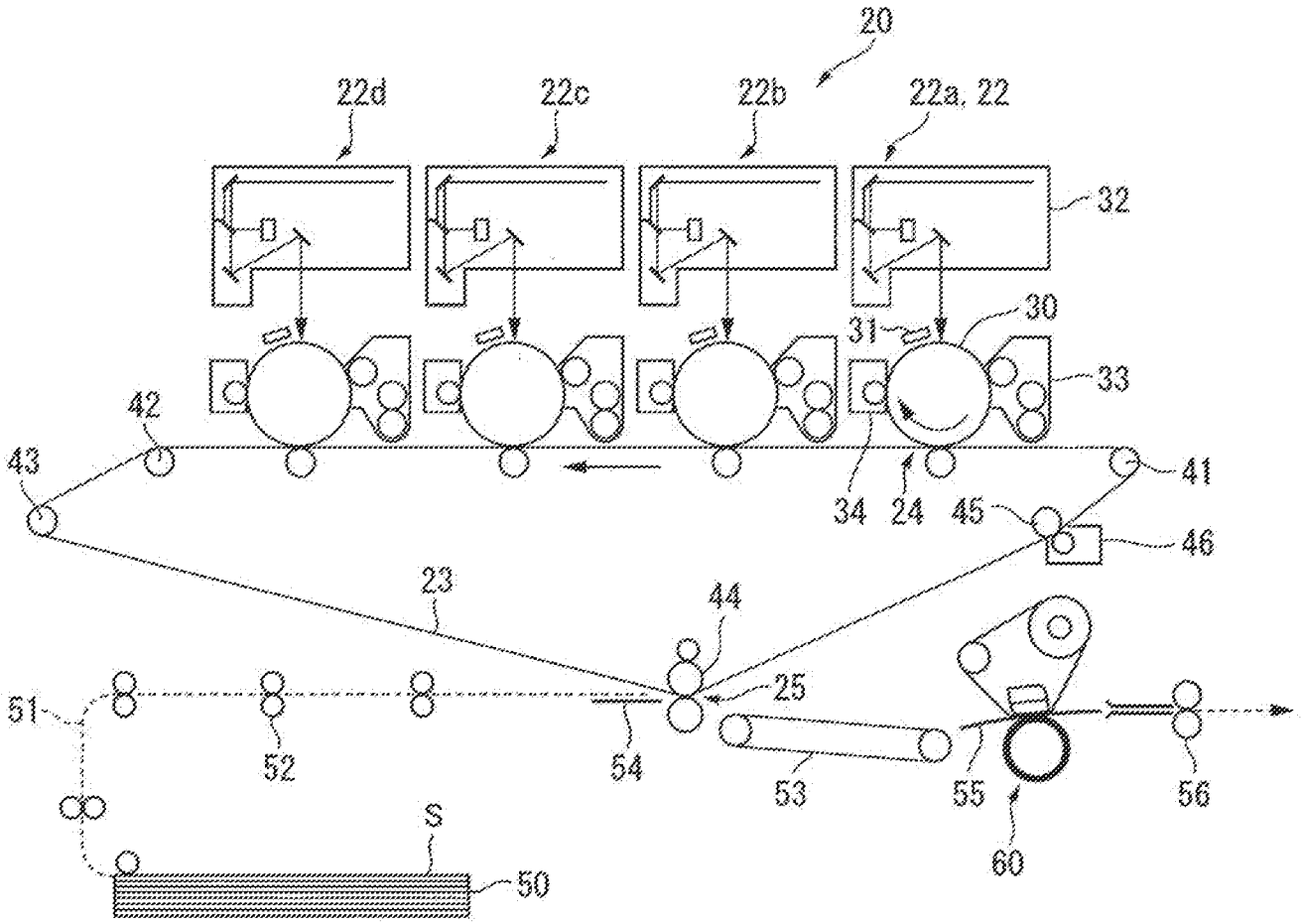
FIG. 2 is an explanatory view illustrating the whole configuration of an image forming apparatus according to Exemplary Embodiment 1.

FIG. 2 is an explanatory view illustrating the whole configuration of an image forming apparatus according to Exemplary Embodiment 1.

In FIG. 2, an image forming apparatus 20 is an intermediate transfer type image forming apparatus referred to as so-called tandem type, and has multiple image forming units 22 (22*a* to 22*d*) in which toner images of color components (four colors: yellow (Y), magenta (M), cyan (C), and black (K) in this example) are formed by an electrophotographic system. A belt-shaped intermediate transfer body 23 is disposed at a position corresponding to each of the image forming units 22, and a first transfer unit 24 (for example, a first transfer roll) is disposed on the back surface of the intermediate transfer body 23 corresponding to the image forming units 22. In addition, in part of the intermediate transfer body 23, a second transfer unit (for example, a second transfer roll) 25 is disposed, in which a toner image of each color component, first transferred from a corresponding image forming unit 22 to the intermediate transfer body 23 by the first transfer unit 24, is second transferred on a recording material S such as paper, a fixing device 60 is disposed on the downstream side of a conveyance direction of the recording material S on which the toner image of each color component has been transferred, and an unfixed toner image on the recording material S is fixed.

Each image forming unit 22 has a drum-shaped photoconductor 30 that rotates in a predetermined direction, and around the photoconductor 30, includes: a charger 31 that charges the photoconductor 30; an exposure device 32, such as a laser scanner, which writes an electrostatic latent image on the photoconductor 30 charged by the charger 31; a developing device 33 that develops the electrostatic latent image written on the photoconductor 30 by the exposure device 32 with corresponding color toner; and a cleaning device 34 that cleans residual material on the photoconductor 30 after a toner image developed by the developing device 33 is first transferred onto the intermediate transfer body 23 by the first transfer unit 24.

The intermediate transfer body 23 is suspended on multiple stretching rolls 41 to 45, and is designed to rotate in circulation in a predetermined direction using, for example, the stretching roll 41 as a drive roll. The stretching roll 44 also serves as an opposed roll to a second transfer roll as the second transfer unit 25, and is designed to generate a second transfer electric field necessary for second transfer between the second transfer roll and the opposed roll. In addition, an intermediate transfer cleaning device 46 is disposed on the surface of the intermediate transfer body 23, corresponding to the stretching roll 45.

In addition, a recording material supply device 50 is provided below the intermediate transfer body 23, and the recording material S supplied from the recording material supply device 50 is to be conveyed along a conveyance path 51 leading to the fixing device 60 through the second transfer unit 25. Note that the conveyance path 51 is provided with an appropriate number of conveyance rolls 52, a conveyance belt 53 for conveying the recording material S from the second transfer unit 25 to the fixing device 60, and in addition, guide plates 54, 55 for guiding the recording material S to a second transfer position of the second transfer unit 25, a fixing position of the fixing device 60, respectively, and discharge rolls 56 to discharge the recording material S to a recording material discharge unit which is not illustrated.

—Fixing Device—

Next, the fixing device 60 used in the exemplary embodiment will be described with reference to FIG. 3.

Figure 3:
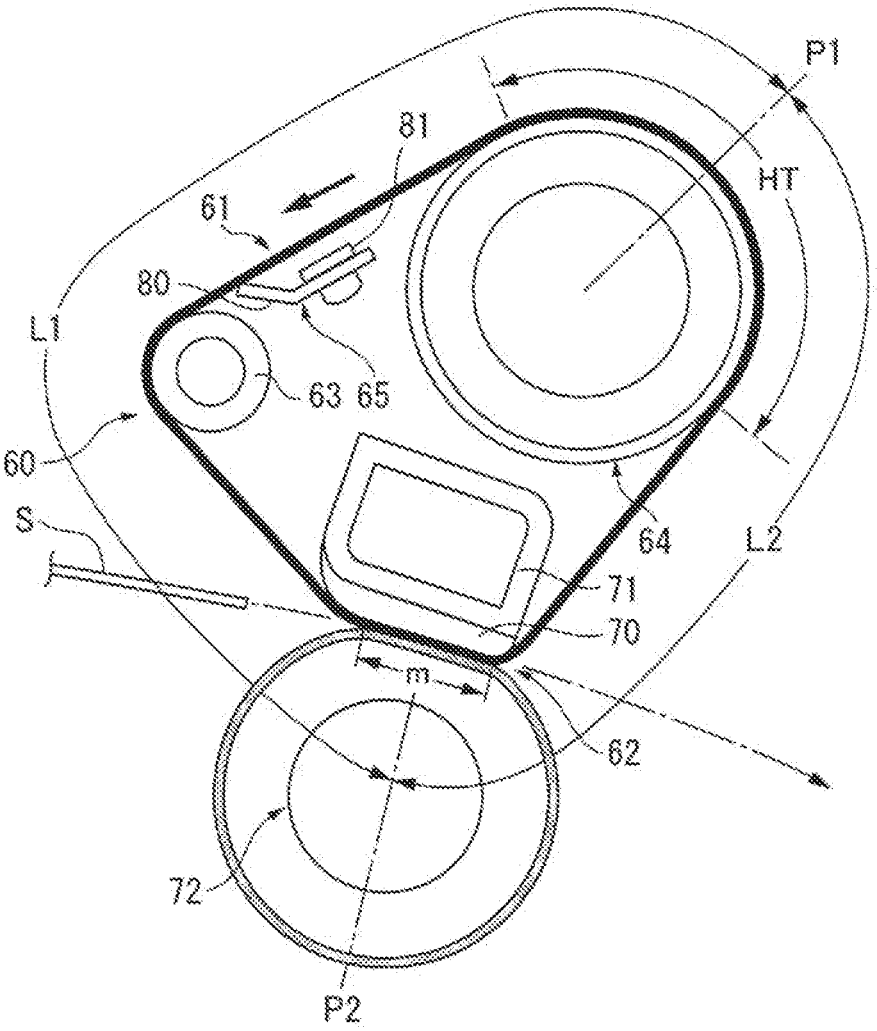
FIG. 3 is an explanatory view illustrating the fixing device used in Exemplary Embodiment 1.

In FIG. 3, the fixing device 60 includes: a fixing belt 61 made of a heat resistant material which moves in circulation; a fixing area formation unit 62 that fixes unfixed image of the recording material S at the fixing area m between which and the fixing belt 61, the recording material S is held and conveyed; a stretching roll 63 that movably stretches the fixing belt 61 in circulation at a position away from the fixing area m of the fixing belt 61 to the upstream side of the movement direction of the fixing belt 61; a resistance heating roll 64 serving as a resistance heating component that movably stretches the fixing belt 61 in circulation, and comes into contact with and heats the fixing belt 61 at a position away from the fixing area m of the fixing belt 61 to the downstream side of the movement direction of the fixing belt 61; and a wick 65 that comes into contact with and applies lubricant to a section of the rear surface of the fixing belt 61, located between the stretching roll 63 and the resistance heating roll 64.

First, the components of the fixing device 60 other than the resistance heating roll 64 will be described, then the resistance heating roll 64 will be described in detail.

<Fixing Belt>

In this example, the fixing belt 61 uses the base material of a resin material having heat resistance, for example, polyimide (PI) resin, and is formed by laminating an elastic layer such as silicon rubber as well as a mold release layer made of a fluorine-based resin on the surface of the base material, thus the thermal conductivity in a thickness direction and a surface direction is low in general.

<Fixing Area Formation Unit>

In this example, in the fixing area formation unit 62, a plate-like pressure pad 70 (made of SUS, liquid crystal polymer, for example) is held in a pad holder 71, the pressure pad 70 serving as a plate-like receiving member and being disposed in contact with the rear surface of the fixing belt 61, and a pressurizing roll 72 as a pressurizing member is pressurized and disposed on the surface of the fixing belt 61 opposed to the pressure pad 70.

In this example, the pressurizing roll 72 is a metal roll with an elastic material such as polyurethane rubber laminated therearound, pressurizes the fixing belt 61 toward the pressure pad 70 to ensure a predetermined fixing area m, and holds and conveys the recording material S in the fixing area m along with movement of the fixing belt 61.

<Stretch Roll>

Since the stretch roll 63 is set on the downstream side of the movement direction of the fixing belt 61 with respect to the resistance heating roll 64, the thermal energy of the fixing belt 61 heated by the resistance heating roll 64 may be lost at a contact point with the stretch roll 63. Thus, in order to reduce heat loss from the stretch roll 63, it is desirable that a protective layer for heat rejection (not illustrated) effective for heat rejection be provided on the surface of the stretch roll 63.

<Wick>

In this example, a wick 65 allows a wick material 80 containing a lubricant to fix to a wick holder 81, and the leading end of the wick material 80 to be arranged in contact with the rear surface of the fixing belt 61.

—Resistance Heating Roll—

Figure 5:
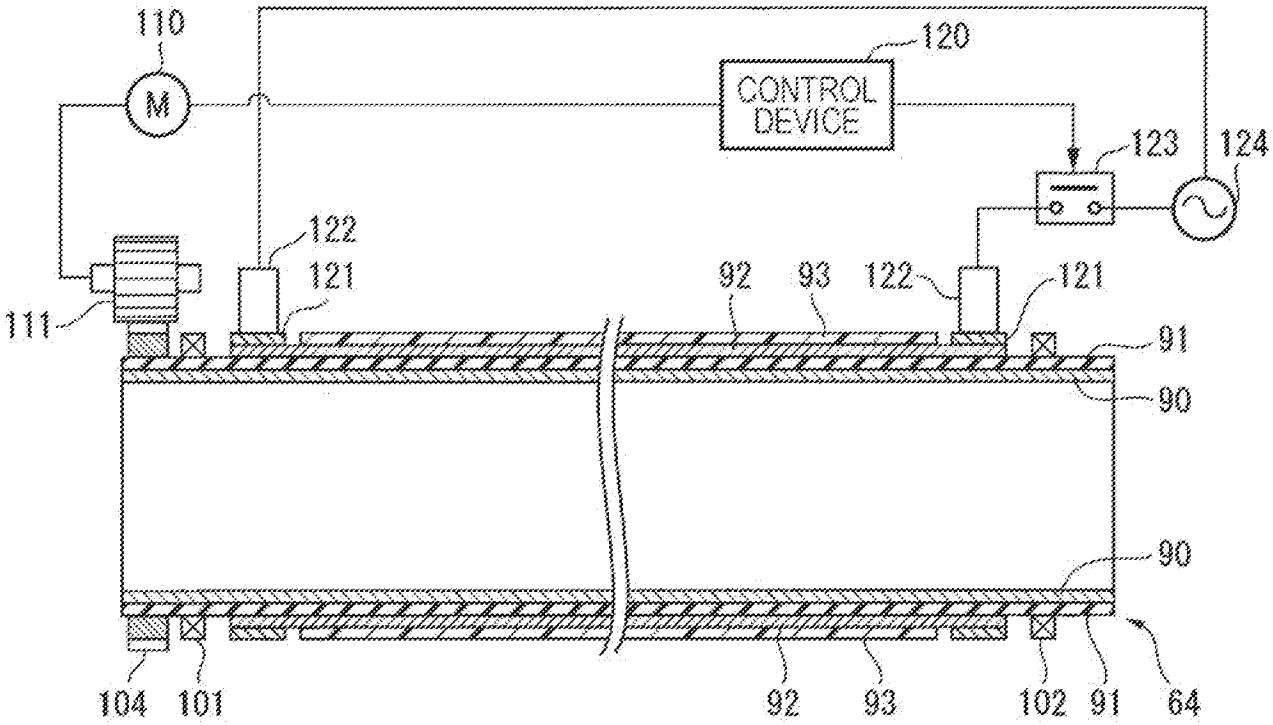
FIG. 5 is an explanatory view illustrating a configuration example of power supply to a resistance heating layer of the resistance heating component used in Exemplary Embodiment 1.
Figure 6A:
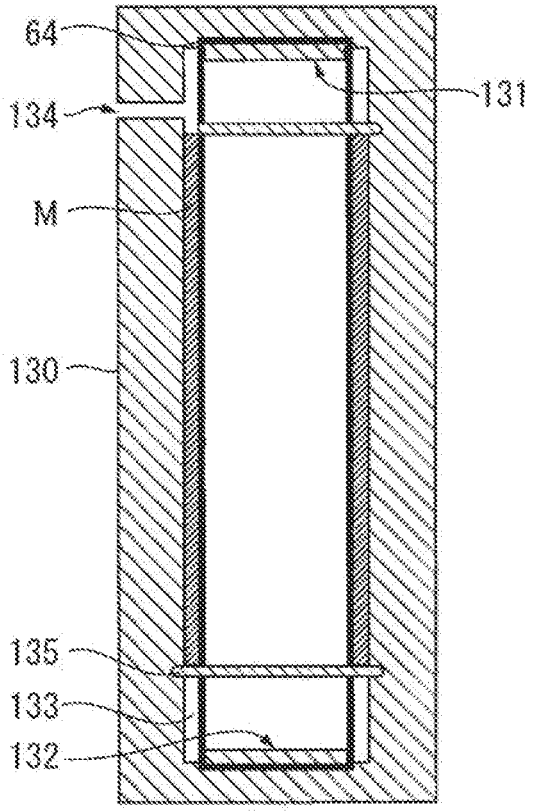
FIG. 6A is an explanatory view illustrating a cast molding coating method used in a method of manufacturing the resistance heating component.
Figure 6B:
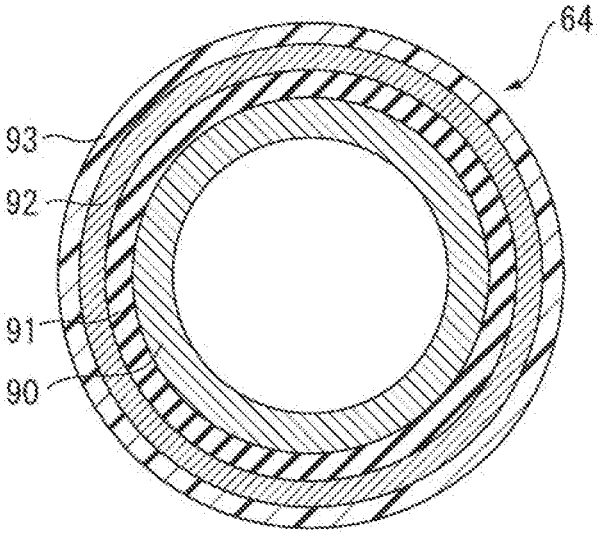
FIG. 6B is a cross-sectional explanatory view of the resistance heating component.

In this example, as illustrated in FIGS. 5 and 6B, the resistance heating roll 64 includes: a metal roll 90 comprised of a metal cylindrical tube as the base material; an insulating layer 91 laminated over substantially the entire area of the circumferential surface of the metal roll 90 with a predetermined thickness; a resistance heating layer 92 laminated over a region of the surface of the insulating layer 91, the region excluding part in the vicinity of both ends of the circumferential surface of the metal roll 90; and a protective layer 93 made of polyimide and/or PEEK material laminated on the resistance heating layer 92.

<Metal Roll>

In this example, the metal roll 90 is comprised of a cylindrical tube configurated of high tensile strength steel, for example, and a wall thickness t is 0.2 to 1.0 mm. When the thickness is less than 0.2 mm, the stiffness is likely to be insufficient, and when the thickness exceeds 1.0 mm, the effect of start-up performance is reduced.

<Insulating Layer>

In this example, the insulating layer 91 may be appropriately selected, however, it is desirable that the insulating layer 91 be formed using one of polyimide (PI), polyamide imide (PAI), diallyl phthalate (PDAP) and polyetheretherketone (PEEK), for example. In particular, when polyimide (PI) is used, it is possible to form the insulating layer 91 with high accuracy using the cast molding coating method described below.

<Resistance Heating Layer>

In this example, the resistance heating layer 92 is obtained by laminating a resistance heating material (for example, silver palladium, gold palladium, carbon metal filler mixture) on a region of the surface of the insulating layer 91 laminated on the surface of the metal roll 90 with a substantially uniform thickness, the region excluding part in the vicinity of both ends of the surface of the insulating layer 91. Note that the resistance heating layer 92 may be formed by a patterned design on the surface of the insulating layer 91.

<Protective Layer>

In this example, the protective layer 93 made of polyimide and/or PEEK material is formed on substantially the entire area of the resistance heating layer 92, and when the rear surface of the fixing belt 61 is stretched by the resistance heating roll 64, the resistance heating layer 92 does not come into contact with the rear surface of the fixing belt 61 directly, and the protective layer 93 comes into contact with the rear surface of the fixing belt 61. The protective layer 93 has a low mold releasability, and is effective to increase wettability of a lubricant and tack power for drive.

<Drive Roll Function of Resistance Heating Roll>

In this example, the resistance heating roll 64 also functions as a drive roll which drives the fixing belt 61.

Figure 4A:
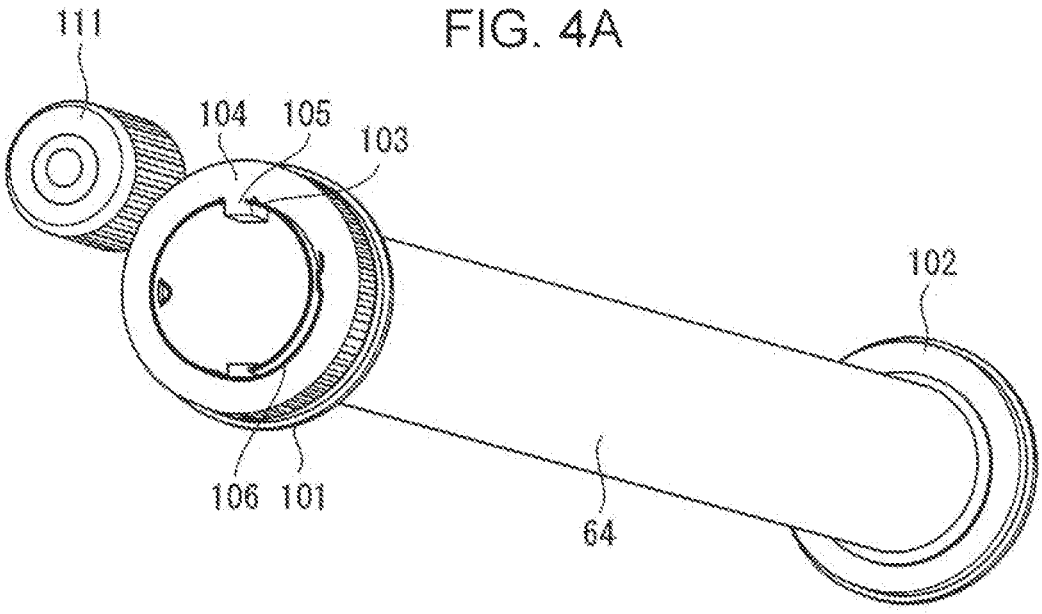
FIG. 4A is an explanatory view illustrating a configuration example of the resistance heating component which is one component of the fixing device.
Figure 4B:
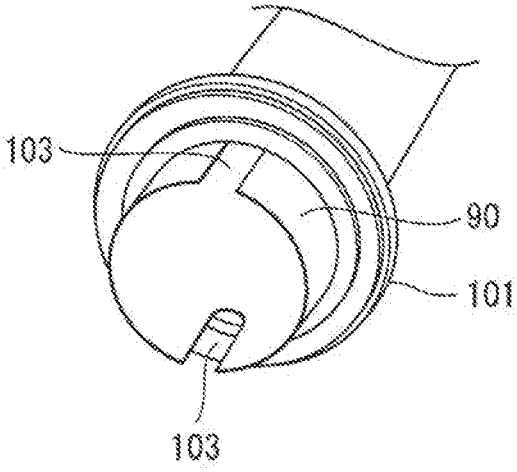
FIG. 4B is an explanatory view illustrating a state in which a drive gear is removed on one end side of the resistance heating component.

Specifically, as illustrated in FIGS. 4A, 4B and FIG. 5, a portion, which is in the vicinity of both ends of the resistance heating roll 64 and in which the insulating layer 91 is exposed, is rotatably held by bearings 101, 102. Then, a key groove 103 is formed at each of multiple positions (two positions in this example) on one end side of the metal roll 90, a drive gear 104 is fitted into the outer side of the bearing 101 of a portion which is in the vicinity of one end of the metal roll 90 and in which the insulating layer 91 is exposed, an anti-rotation projection 105 formed at an inner circumferential portion of the drive gear 104 is caught in the key groove 103 of the metal roll 90, retained by a clip 106, and the drive gear 104 is fixed to the one end of the resistance heating roll 64. The drive gear 104 is engaged with an input gear 111 to which a driving force from a drive motor 110 is transmitted, the drive motor 110 is controlled according to a control signal from a control device 120, and the resistance heating roll 64 is driven as a drive roll with rotation of the input gear 111.

<Power Supply Structure of Resistance Heating Roll>

In this example, for example, as illustrated in FIG. 5, the power supply structure of the resistance heating roll 64 is implemented as follows: the protective layer 93 in the vicinity of both ends of the resistance heating layer 92 is removed, a ring-shaped electrode 121 is formed at the portion removed, a power supply contact point 122 in contact with the electrode 121 is provided, and a heating start switch 123 is turned on by a control signal from the control device 120, thus electric power from a power supply electric source 124 is supplied from the power supply contact point 122 to the resistance heating layer 92 through the electrode 121 to heat the resistance heating layer 92.

Note that the power supply structure of the resistance heating roll 64 is not limited to this, and may be appropriately selected, for example, power is supplied from both shaft ends of the metal roll 90.

<Method of Manufacturing Resistance Heating Roll>

Next, a method of manufacturing the resistance heating roll 64 according to the exemplary embodiment will be described.

In this example, the metal roll 90 is high tensile strength steel, and the insulating layer 91 is polyimide (PI), thus the cast molding coating method is used in the insulating layer formation step.

More specifically, in this example, the method of manufacturing the resistance heating roll 64 includes layer formation steps in which the insulating layer 91, the resistance heating layer 92 and the protective layer 93 are successively formed on the outer circumference of the metal roll 90. In at least the insulating layer formation step of the layer formation steps, as illustrated in FIG. 6A, a cast molding coating method is used in which the metal roll 90 is positioned by both end position determiners 131,132, a mold 130 is used which partitions a hollow section 133 between the metal roll 90 and the outer circumference of the metal roll 90, the hollow section 133 corresponding to the thickness of the insulating layer 91 to be formed, and the insulating layer 91 to be formed is coated by casting a coating material M for the insulating layer 91 to be formed into the hollow section 133, and calcining the coating material M.

In this example, since the metal roll 90 is high tensile strength steel, due to the effect of processing accuracy, the cylindricity of the metal roll 90 is not closer to the cylindricity of a cylinder. However, using the cast molding coating method, when the outer circumferential surface of the mold 130 is produced accurately, the circularity of the insulating layer 91 after molding is closer to the circularity of a circle than the circularity of the metal roll 90. Thus, when the resistance heating layer 92 is formed on the insulating layer 91, it is advantageous in that the thickness of the resistance heating layer 92 is likely to be maintained more uniformly, as compared with when the resistance heating layer 92 is directly formed on the surface of the metal roll 90.

In addition, regarding the surface roughness, it is advantageous in that the surface of the insulating layer 91 is likely to be smoother than the surface of the metal roll 90.

Note that in FIG. 6A, laminated regions on the outer circumference of the metal roll 90 vary with the insulating layer 91, the resistance heating layer 92, the protective layer 93, and a symbol 135 indicates a sealing member which regulates the region where the coating material M is spread in the hollow section 133 in the mold 130 to form each of the layers. In this example, a case has been described in which the insulating layer formation step is performed. When the insulating layer 91 is formed on substantially the entire area of the outer circumference of the metal roll 90, the sealing member 135 is unnecessary.

Also, in this example, the cast molding coating method has been described using the insulating layer formation step as an example. However, when the cast molding coating method is used for the resistance heating layer formation step or the protective layer formation step, a mold may be prepared in advance according to a selection of a position of the outer circumferential surface and a position of the inner circumferential surface of the hollow section 133, or a setting position of the sealing member 135, and the thicknesses of the resistance heating layer 92 and the protective layer 93 which are to be formed.

<Layout of Resistance Heating Roll>

In this example, the layout of the resistance heating roll 64 is as illustrated in FIG. 3.

First, as illustrated in FIG. 3, a metal roll 90 having a large outer diameter is used as the resistance heating roll 64, thus the region HT where the fixing belt 61 is stretched is widely secured, and accordingly, a large amount of heat conduction from the resistance heating roll 64 to the fixing belt 61 is secured.

Let L1 be the distance from a contact center position P1 of the resistance heating roll 64 with the fixing belt 61 to a central position P2 of the fixing area m in a circulation movement direction of the fixing belt 61, and L2 be the distance from the central position P2 of the fixing area m to the contact center position P1 in the circulation movement direction of the fixing belt 61. In this example, selection is made so that L1>L2 is satisfied.

The reason for this selection is as follows.

Figure 7A:
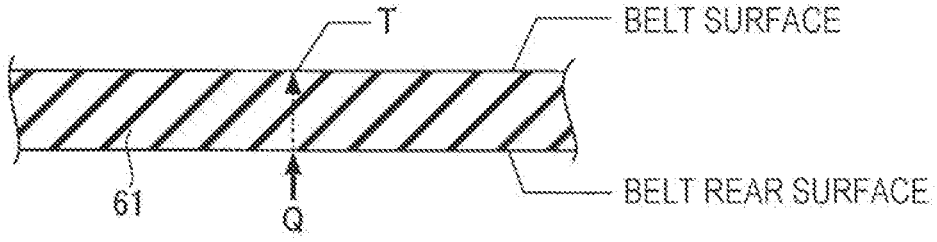
FIG. 7A is an explanatory view schematically illustrating the operation principle of a fixing device according to the exemplary embodiment.
Figure 7B:
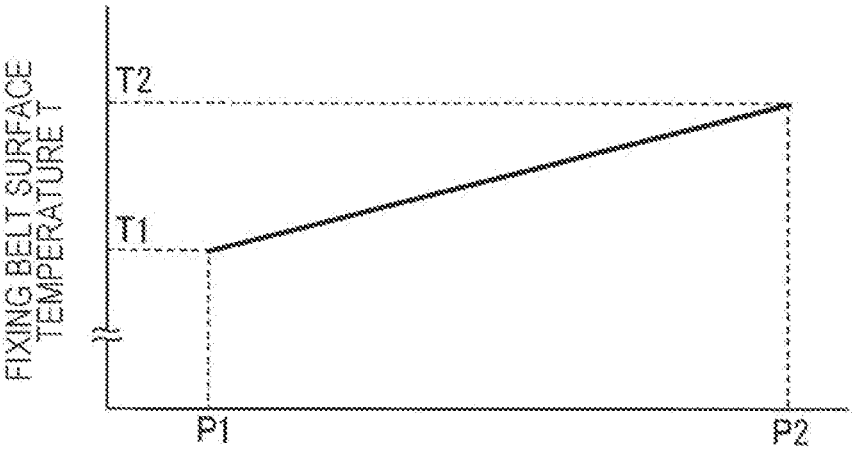
FIG. 7B is an explanatory graph schematically illustrating a change state of the surface temperature distribution of the fixing belt from a position P1 of the resistance heating component to a position P2 of a fixing area of the fixing belt.

That is, as illustrated in FIG. 7A, the rear surface side of the fixing belt 61 is heated by the resistance heating roll 64 with an amount of heat Q, however, the thermal conductivity of the fixing belt 61 is low, thus the temperature T of the surface side of the fixing belt 61 does not immediately increase. Thus, in this example, as illustrated in FIG. 7B, the time taken for heat to conduct to the surface side is increased by increasing the distance L2 along the fixing belt 61 until the fixing belt 61 heated by the resistance heating roll 64 reaches the fixing area m, the heat being consumed for heating the rear surface of the fixing belt 61, thus the surface temperature of the fixing belt 61 at P1 has sufficiently increased at a stage when P2 is reached, the fixing belt 61 which has reached the fixing area m assumes a state in which the surface side is sufficiently heated, and heating energy in the fixing area m provided by the fixing belt 61 is sufficiently secured.

—Modification of Resistance Heating Component—

Modification 1

Figure 8A:
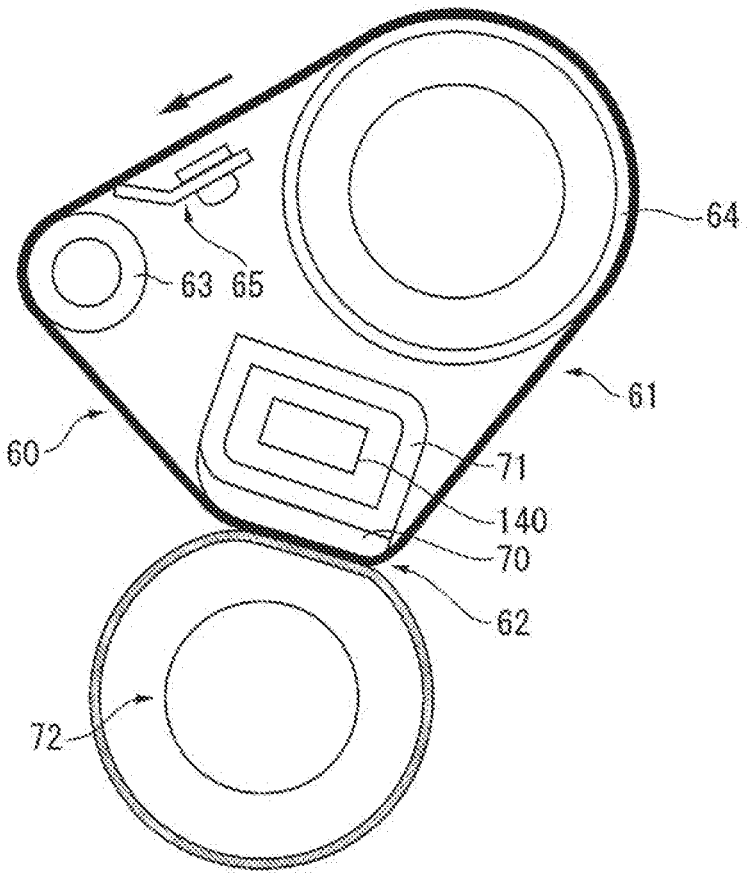
FIG. 8A is an explanatory view illustrating a fixing device according to Modification 1.

FIG. 8A illustrates a fixing device 60 according to Modification 1.

In FIG. 8A, the basic configuration of the fixing device 60 is almost the same as that of Exemplary Embodiment 1, however, unlike Exemplary Embodiment 1, an auxiliary heating source 140 such as a halogen lamp is separately added into the pad holder 71 on the rear surface of the fixing area m.

When the recording material S is held and conveyed at the fixing area m, heat loss from the recording material S and each component of the fixing area formation unit 62 is inevitable, thus in this example, the auxiliary heating source 140 does not actively heat the fixing belt 61 located at the fixing area m, but rather avoids increase in the heat loss from the fixing belt 61 at the fixing area m by compensating the heat loss.

Modification 2

Figure 8B:
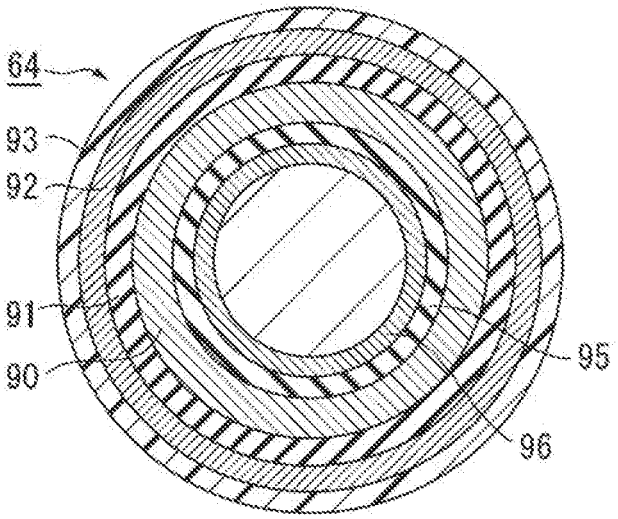
FIG. 8B is an explanatory view illustrating a resistance heating component according to Modification 2.

FIG. 8B illustrates a resistance heating roll according to Modification 2.

In FIG. 8B, the resistance heating roll 64 includes the insulating layer 91, the resistance heating layer 92 and the protective layer 93 on the outer surface of the metal roll 90, and in addition, a resistance heating layer 96 is formed on the inner surface of the metal roll 90 with an insulating layer 95 interposed between the heating layer 96 and the metal roll 90.

Thus, it is advantageous in that the heat generation efficiency achieved by the resistance heating roll 64 is higher than the heat generation efficiency of Exemplary Embodiment 1.

Modification 3

Figure 8C:
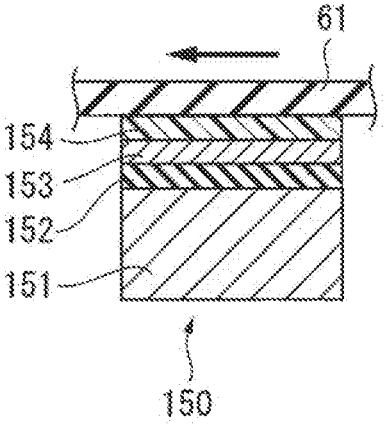
FIG. 8C is an explanatory view illustrating a resistance heating component according to Modification 3.

In FIG. 8C, as the resistance heating component 150 in fixing belt 61, a flat plate-shaped base material 151 rather than the metal roll 90 is prepared, an insulating layer 152, a resistance heating layer 153 and a protective layer 154 made of polyimide and/or PEEK material are laminated on the surface of the base material 151, and the resistance heating component 150 is brought into contact with the rear surface of the fixing belt 61.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A resistance heating component configured to contact and heat a fixing belt made of a heat resistant material, the resistance heating component being configured such that all parts of the resistance heating component may be provided at a position away from a fixing area configured to hold and convey a recording material using the fixing belt, the resistance heating component comprising:

a metal base material; and a resistance heating layer laminated on a front surface or a rear surface of the base material with an insulating layer interposed between the base material and the resistance heating layer, wherein a surface roughness of the insulating layer is less than a surface roughness of the base material.

2. The resistance heating component according to claim 1, wherein the base material is a metal roll comprising a cylindrical body made of metal.

3. The resistance heating component according to claim 2, wherein the metal roll comprises high tensile strength steel which has a tensile strength of 490 MPa or higher.

4. The resistance heating component according to claim 3, wherein the metal roll has a thickness of 0.2 to 1.0 mm.

5. The resistance heating component according to claim 2, wherein the metal roll has a thickness of 0.2 to 1.0 mm.

6. The resistance heating component according to claim 2, wherein the resistance heating layer is laminated on an outer surface of the metal roll with the insulating layer interposed between the metal roll and the resistance heating layer.

7. The resistance heating component according to claim 1, wherein if the resistance heating layer is provided on the front surface of the base material, the resistance heating layer is covered with a protective layer.

8. The resistance heating component according to claim 1, wherein the insulating layer is formed using one of polyimide (PI), polyamide imide (PAI), diallyl phthalate (PDAP) and polyetheretherketone (PEEK).

9. A fixing device comprising:

a fixing belt made of a heat resistant material, wherein the fixing belt is configured to move in circulation;

a fixing area formation device configured to fix an unfixed image of a recording material at a fixing area configured to hold and convey the recording material using the fixing belt; and the resistance heating component according to claim 1, configured to contact and heat the fixing belt at a position away from the fixing area of the fixing belt.

10. The fixing device according to claim 9, wherein the resistance heating component contacts a rear surface of the fixing belt.

11. The fixing device according to claim 10, wherein the resistance heating component is configured as a stretch roll that stretches the fixing belt.

12. The fixing device according to claim 10, wherein the resistance heating component is configured as a stretch roll that stretches the fixing belt and is configured as a drive roll that drives the fixing belt.

13. The fixing device according to claim 10, wherein a distance L1 from a contact center position of the resistance heating component with the fixing belt to a central position of the fixing area in a circulation movement direction of the fixing belt is longer than a distance L2 from the central position of the fixing area to the contact center position in the circulation movement direction of the fixing belt.

14. The fixing device according to claim 10, wherein the fixing area formation device includes an auxiliary heating element configured to reduce heat loss when the fixing belt heated by the resistance heating component passes through the fixing area.

15. An image forming apparatus comprising:

an image producing device configured to produce an image on a recording material; and the fixing device according to claim 9, configured to fix an unfixed image produced by the image producing device.

16. A resistance heating component configured to contact and heat a fixing belt made of a heat resistant material, the resistance heating component being configured such that all parts of the resistance heating component may be provided at a position away from a fixing area configured to hold and convey a recording material using the fixing belt, the resistance heating component comprising:

a metal base material; and a resistance heating layer laminated on a front surface or a rear surface of the base material with an insulating layer interposed between the base material and the resistance heating layer, wherein the resistance heating component is configured as a stretch roll that stretches the fixing belt and is configured as a drive roll that drives the fixing belt.

17. A resistance heating component configured to contact and heat a fixing belt made of a heat resistant material, the resistance heating component being configured such that all parts of the resistance heating component may be provided at a position away from a fixing area configured to hold and convey a recording material using the fixing belt, the resistance heating component comprising:

a metal base material; and a resistance heating layer laminated on a front surface or a rear surface of the base material with an insulating layer interposed between the base material and the resistance heating layer, wherein a distance L1 from a contact center position of the resistance heating component with the fixing belt to a central position of the fixing area in a circulation movement direction of the fixing belt is longer than a distance L2 from the central position of the fixing area to the contact center position in the circulation movement direction of the fixing belt.

18. A fixing device comprising:

a resistance heating component configured to contact and heat a fixing belt made of a heat resistant material, the resistance heating component being configured such that all parts of the resistance heating component may be provided at a position away from a fixing area configured to hold and convey a recording material using the fixing belt, the resistance heating component comprising:

a metal base material; and a resistance heating layer laminated on a front surface or a rear surface of the base material with an insulating layer interposed between the base material and the resistance heating layer; and a fixing area formation device configured to fix an unfixed image of a recording material at a fixing area configured to hold and convey the recording material using the fixing belt, wherein the fixing area formation device includes an auxiliary heating element configured to reduce heat loss when the fixing belt heated by the resistance heating component passes through the fixing area.

* * * * *